US008376202B2

(12) United States Patent
Baker

(10) Patent No.: US 8,376,202 B2
(45) Date of Patent: Feb. 19, 2013

(54) APPARATUS FOR RECOVERING HOSE

(76) Inventor: Clinton D. Baker, Lorena, TX (US)

( * ) Notice: Subject to any disclaimer, the term of this patent is extended or adjusted under 35 U.S.C. 154(b) by 359 days.

(21) Appl. No.: 11/854,763

(22) Filed: Sep. 13, 2007

(65) Prior Publication Data

US 2008/0067280 A1 Mar. 20, 2008

Related U.S. Application Data

(60) Provisional application No. 60/825,671, filed on Sep. 14, 2006.

(51) Int. Cl.
*A62C 33/00* (2006.01)
*B65H 51/10* (2006.01)

(52) U.S. Cl. ..... 226/1; 137/355.2; 226/90; 226/177; 226/183; 226/188; 226/194

(58) Field of Classification Search ..... 226/1, 89, 226/90, 176, 177, 180, 183, 186, 187, 188, 226/190, 193, 194; 242/397.5, 406, 535, 242/535.3, 535.5, 539, 548.2, 564.4; 137/355.2–355.22; 254/333
See application file for complete search history.

(56) References Cited

U.S. PATENT DOCUMENTS

| | | | | |
|---|---|---|---|---|
| 1,915,632 | A * | 6/1933 | Marks | 242/397.5 |
| 1,981,411 | A * | 11/1934 | Fritz | 266/112 |
| 2,396,451 | A | 3/1946 | Warkentin | |
| 2,929,494 | A * | 3/1960 | Lombardi | 226/183 |
| 2,960,279 | A | 11/1960 | Little | |
| 3,124,321 | A | 3/1964 | Rylott | |
| 3,658,222 | A * | 4/1972 | Dressel et al. | 226/25 |
| 3,713,301 | A * | 1/1973 | Bryant | 405/177 |
| 3,866,532 | A * | 2/1975 | Ogden, Jr. | 100/171 |
| 3,946,964 | A | 3/1976 | Zinser | |
| 4,117,991 | A | 10/1978 | Johnson | |
| 4,198,010 | A | 4/1980 | Knapp | |
| 4,452,135 | A | 6/1984 | Hayes | |
| 4,815,201 | A * | 3/1989 | Harris | 29/727 |
| 5,205,509 | A | 4/1993 | Noggle | |
| 5,505,404 | A * | 4/1996 | Dubreuil | 242/532.6 |
| 5,560,400 | A * | 10/1996 | Meyns et al. | 139/304 |
| 5,566,901 | A | 10/1996 | Wilder | |
| 5,775,563 | A * | 7/1998 | Kojima | 226/92 |
| 6,305,592 | B1 * | 10/2001 | Mann | 226/45 |
| 6,352,215 | B1 * | 3/2002 | Cash et al. | 242/574.2 |
| 6,622,957 | B1 | 9/2003 | Fleming | |
| 6,811,110 | B2 | 11/2004 | Tsao | |
| 2005/0011979 | A1 | 1/2005 | Best | |
| 2006/0162782 | A1 | 7/2006 | McNeese | |

FOREIGN PATENT DOCUMENTS

| | | | |
|---|---|---|---|
| DE | 4214925 | C1 | 10/1993 |
| EP | 0631796 | B1 | 9/1997 |
| JP | 08229157 | A * | 9/1996 |

OTHER PUBLICATIONS www.etshosereels.com/Industrial-Hose-Reels.htm.

* cited by examiner

*Primary Examiner* — Michael Mansen
*Assistant Examiner* — Scott Haugland
(74) *Attorney, Agent, or Firm* — Davis Miles McGuire Gardner PLLC; Gregory S. Donahue

(57) ABSTRACT

An apparatus for recovering hose, particularly coupled fire hose, comprises a lifting frame assembly, a lifting arm attached to the lifting frame assembly, a plurality of guide rollers, a motor mounted on the lifting frame assembly, an electric switch, a powered rotational drive roller, a plurality of lower rollers, and a detachable support assembly. A biasing means biases the lifting frame assembly to a plurality of guide roller mounts to allow lifting and lowering of the lifting frame assembly to and from at first and second position to allow passage of hose fitted with hose couplings. When using the relatively simple apparatus, a single operator can efficiently collect infinite quantities of hose fitted with hose couplings.

11 Claims, 2 Drawing Sheets

APPARATUS FOR RECOVERING HOSE

CROSS-REFERENCE TO RELATED APPLICATIONS

The present application claims the benefit of Provisional Application No. 60/825,671 filed Sep. 14, 2006, which is incorporated herein by reference.

BACKGROUND

The present inventive subject matter relates to an apparatus for recovering flexible hose for conveying liquid, such as fire hose.

It is well known in the field of fire fighting that long portions of flexible fire hose are difficult to recover and replace into the fire engine bed after the fire is extinguished. Flexible hoses of this type are made up of sections which are provided with hose couplings at both ends. The couplings are made of metal and cannot be compressed like the hose itself. In typical day-to-day practice, several firefighters are necessary to recover and replace the hose, depending on the weight and length of the hose. A team of firefighters would either manually roll or fold up the flexible hose for storage on the fire engine. Such burdensome practice could take the firefighters many hours, and sometimes days, to complete.

Information relevant to attempts to address the above-referenced problems can be found in U.S. Pat. No. 6,622,957 to Fleming (2003), U.S. Pat. No. 4,117,991 to Johnson (1978), U.S. Pat. No. 4,452,135 to Hayes (1984), U.S. Pat. No. 5,566,901 to Wilder (1996), U.S. Pat. No. 5,205,509 to Noggle (1993), U.S. Pat. No. 3,946,964 to Zinser (1976), U.S. Pat. No. 2,960,279 to Little (1960), U.S. Pat. No. 2,396,451 to Warkentin (1945), U.S. Pat. No. 4,198,010 to Knapp (1980), and U.S. Pat. No. 3,124,321 Rylott et al. (1964), European Patent No. 0631796 to Kuilken (1997) and German Patent No. 4214925 to Botmann (1993).

However, each one of these references suffers from one or more of the following disadvantages:

1. Inability to recover large quantities of hose without expending substantial effort, time and manpower;
2. Inability to compactly recover hose fitted with hose couplings;
3. Disassembly of the apparatus to remove the wound hose;
4. Utilization of complex and unreliable pulley and sensing units;
5. Expensive to purchase;
6. Expensive to maintain;
7. Collection of hose in a confined area within the apparatus;
8. Utilization of complex mechanical belting mechanisms;
9. Risk associated with couplings getting stuck in the apparatus;
10. Operational belts being flung off the apparatus;
11. Debris being thrown off the hose by the apparatus causing damage or injury;
12. The apparatus lacks adjustability.

For the foregoing reasons, there is a need for a hose recovery system that facilitates the economical and efficient collection of significant amounts of coupled fire hose using a relatively inexpensive apparatus that is easy to maintain, adjustable and can be operated by a single operator.

SUMMARY

The present invention is directed to an apparatus for recovering hose that eliminates the disadvantages of the prior art and which enables infinite amounts of coupled fire hose to be recovered efficiently and economically by an adjustable apparatus that is easy to maintain and can be operated by a single operator.

These and other objects and advantages of the present invention are achieved in accordance with an apparatus for recovering hose comprising a lifting frame assembly having a plurality of lifting frame arms and a lifting arm. The lifting arm includes an affixed lifting handle and an electric switch. The apparatus for recovering hose further comprises a plurality of guide rollers. A biasing means such as a hinge allows for lowering the lifting frame arms into a first position and lifting the lifting frame arms into a second position. A motor is mounted atop the lifting frame assembly. The motor is coupled to a drive system comprising a cylindrical rotational drive roller, a motor sprocket, a rotational drive roller sprocket, an idler sprocket and a drive chain. The apparatus for recovering hose further comprises a plurality of lower rollers and an adjustable, detachable support assembly. The support assembly comprises a tray plate, a rotatable tray plate hub and spindle, a swing arm, a swing arm hub and spindle and a base plate.

As a result of this structure, a single operator can control the motor by depressing and releasing the electric switch. In a first position, a hose is disposed between the rotational drive roller and the lower rollers. Upon actuation of the rotational drive roller, the hose feeds through the apparatus and the hose can be collected and stored. When a coupling is encountered, the operator can manually lift the lifting arm into a second position to easily allow the coupling to pass. During a hose recovery operation, the rotational drive roller and the lower rollers remain in contact with the hose and/or the hose coupling, depending on which is passing through the apparatus at that particular point in time.

The present invention gives the advantages of enabling to recover 3000 feet of hose of most diameters in only 30 minutes utilizing one operator and one other man recovering and storing hose into the fire engine hose bed.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
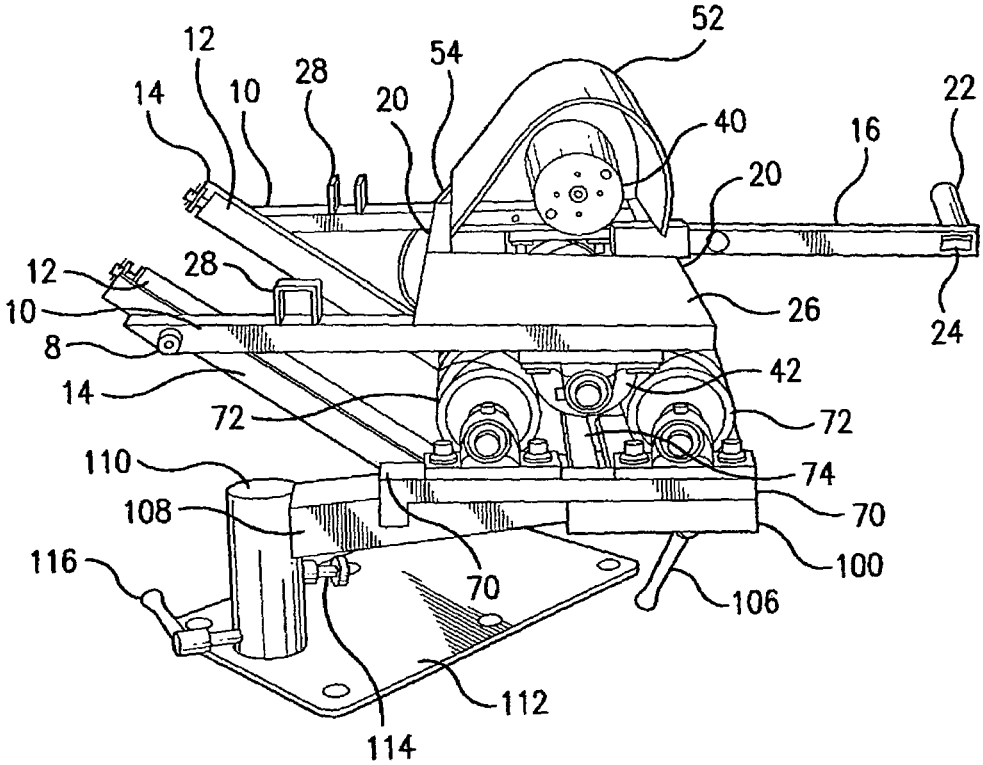
FIG. 1 is a perspective view of an embodiment of the present invention.
Figure 2:
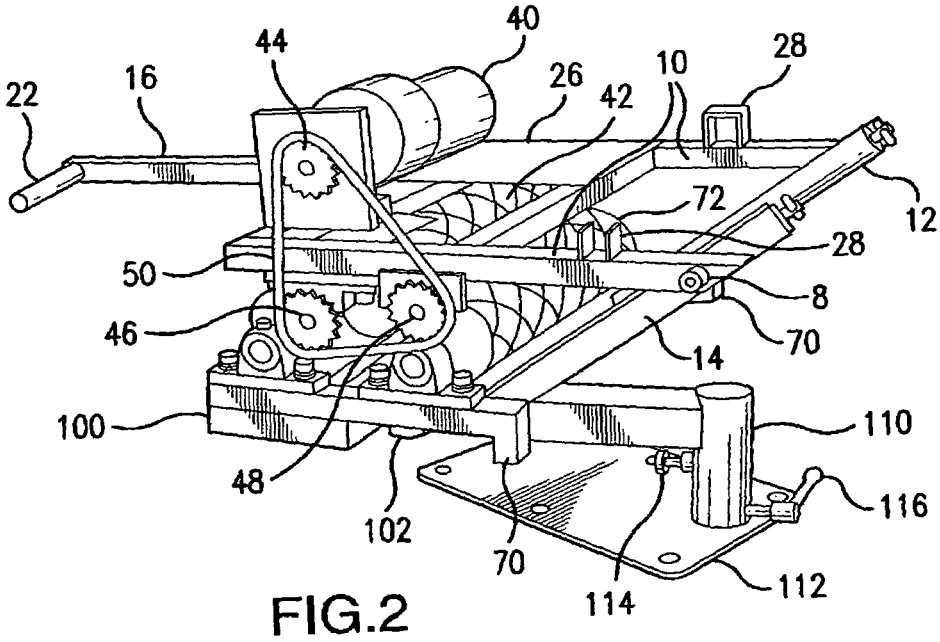
FIG. 2 is a rotated perspective view of the invention.

Structures of embodiments of the present invention are shown in FIG. 1-2, wherein an apparatus for recovering hose includes a lifting frame assembly comprising a plurality of lifting frame arms 10 and a lifting arm 16. In the preferred embodiment, the lifting frame arms 10 and the lifting arm 16 are constructed of fourteen gauge, one inch square tubing. The lifting arm 16 includes an affixed lifting handle 22 and an electric switch 24. The lifting handle 22 is preferably fitted with a grip suited to an operator's comfort. The electric switch is preferably a 15 amp momentary rocker switch. The plurality of lifting frame arms 10 are coupled to a plurality of guide roller mounts 14 by a plurality of biasing means hinges 8, such as ½ inch stainless steel shoulder bolts, to allow for lowering of the lifting frame arms 10 into a first position and lifting the lifting frame arms 10 into a second position. A plurality of guide rollers 12, preferably 1½ inch, constructed of galvanized steel, are attached to the plurality of guide roller mounts 14. The lifting frame assembly further comprises a plurality of support arms 20, preferably of one inch square tubing, attached between and perpendicular to the plurality of lifting frame arms 10. The lifting arm 16 is removably attached to the center of one of the support arms 20, preferably in the position shown in FIG. 1-2. A flat safety plate 26, preferably constructed of 16 gauge to 18 gauge sheet metal, covers the plurality of support arms 20 and one of the lifting frame arms 10 to protect a user of the apparatus for recovering hose from injury. A plurality of lifting arm storage brackets 28 affixed to the lifting frame arms 10 allow for storage of the lifting arm 16 when the lifting arm 16 is removed from the apparatus. The lifting arm 16 may be removed from the apparatus and stored during periods of time when the apparatus is dormant.

A motor 40, preferably a 12 volt gear reduced electric motor, is mounted atop the lifting frame assembly. Other means of powering the apparatus, such as a 5 horsepower gas-powered motor with a 6:1 gear reducer, may also be used. Those skilled in the art will understand that a power supply (not shown) supplies power to the motor 40, which is thereafter mechanically coupled to a drive system shown on FIG. 2. The drive system comprises a rotational drive roller 42, which is constructed with a 3½ inch diameter in cylindrical form, preferably with a pliable surface such as diamond groove vulcanized rubber lagging with a rubber derometer of 60. The rotational drive roller 42 is removably secured on each of its ends to the plurality of lifting frame arms 10 on the opposite side of the motor 40. The rotational drive roller 42 may be secured to the lifting frame arms 10 by any available securing means, including bolting, welding, clamping or any similar securing means. The drive system further comprises a motor sprocket 44, preferably of 3½ inch diameter, a rotational drive roller sprocket 46, preferably of 3 inch diameter, and an idler sprocket 48, preferably of 3½ inch diameter, which are all corotational sprockets connected via a drive chain 50. Those skilled in the art will understand that the electric switch 24 is normally connected via electrical wiring means to the motor 40 and that an operator's depression of the electric switch 24 supplies power to and activates the motor 40. Similarly, the operator's release of the electric switch 24 eliminates power to and deactivates the motor 40. When the operator of the apparatus for recovering hose depresses electric switch 24 and the motor 40 actuates, the motor 40 engages the motor sprocket 44, which in turn sets into motion the idler sprocket 48, which in turn sets into motion the rotational drive roller sprocket 46 for the reason that all are interconnected and continuously propelled by the drive chain 50. The rotational drive roller sprocket 46 is coupled to rotational drive roller 42. The actuation of the motor sprocket 44, and then in turn the actuation of the idler sprocket 48 and then in turn the actuation of the rotational drive roller sprocket 46 causes the rotational drive roller 42 to rotate counterclockwise on its own axis, as the reader views the apparatus as it is situated in FIG. 1. A motor cowling 52 and a drive cowling 54, both preferably constructed of 16 gauge sheet metal, are removably attached to the lifting frame arms 10 and cover the drive system and the motor 40. The motor cowling 52 and the drive cowling 54 protect the apparatus and the operator from damage or injury.

The plurality of guide roller mounts 14 are secured to a plurality of lower roller support arms 70, preferably constructed of one inch square tubing. A plurality of lower rollers 72, preferably 3½ inches in diameter, are secured at each of their ends to the plurality of lower roller support arms 70. The plurality of lower rollers 72 may be secured to the plurality of lower roller support arms 70 by any available securing means, including bolting, welding, clamping or any similar securing means. The plurality of lower rollers 72 are constructed preferably with a pliable surface such as diamond groove vulcanized rubber lagging with a rubber derometer of 60. The plurality of lower rollers 72 are freely rotatable about their respective axes. A plurality of lower roller support arm support members 74, constructed of one inch square tubing, are attached underneath and perpendicular to the lower roller support arms 70.

Figure 3:
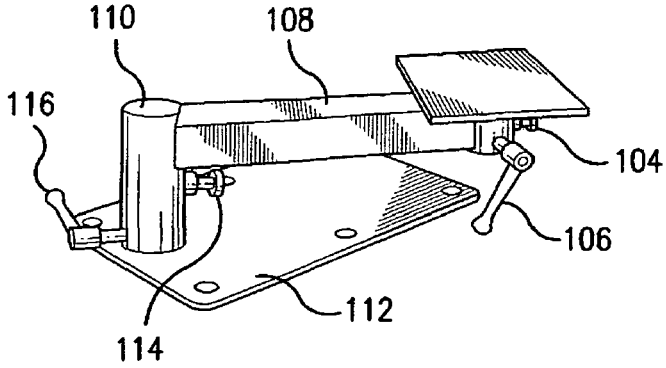
FIG. 3 is a perspective view of the support assembly.

As shown in FIG. 1-2 and more fully shown in FIG. 3, the lower roller support arm support members 74 are disposed into an adjustable, detachable support assembly. The adjustable support assembly comprises a removably attached tray plate 100, a rotatable tray plate hub and spindle 102, a swing arm 108, a swing arm hub and spindle 110, and a base plate 112. The tray plate 100, constructed of steel, is preferably secured to the lower roller support arm support members by a common lock pin (not shown). The tray plate 100 is secured to the rotatable tray plate hub and spindle 102. The tray plate hub and spindle 102 are detachably affixed together by a spring loaded tray plate lock pin 104. A tray plate locking handle 106, in a tray plate locking handle closed position, prevents rotation of the tray plate 100 about the tray plate hub and spindle 102. In a tray plate locking handle's open position, rotation of the tray plate 100 about the tray plate hub and spindle 102 can occur. The swing arm 108, preferably constructed of 2 inch square tubing with a ¼ inch to ⅜ inch wall, is attached to and disposed between the tray plate hub and spindle 102 and the swing arm hub and spindle 110. The swing arm hub and spindle 110 are detachably affixed together by a spring loaded tray plate lock pin 114. A swing arm locking handle 116, in a swing arm locking handle's closed position, prevents rotation of the swing arm 108 about the swing arm hub and spindle 110. In a swing arm locking handle's open position, rotation of the swing arm 108 about the swing arm hub and spindle 110 can occur. The swing arm hub and spindle 110 is removably attached to the base plate 112. The base plate 112 can be mounted to a hose collection and storage container, preferably a fire truck. The rotatability of both the swing arm 108 and the tray plate 100 provide the operator with the ability to adjust the apparatus for recovering hose into the operator's desired operating position.

Figure 4:
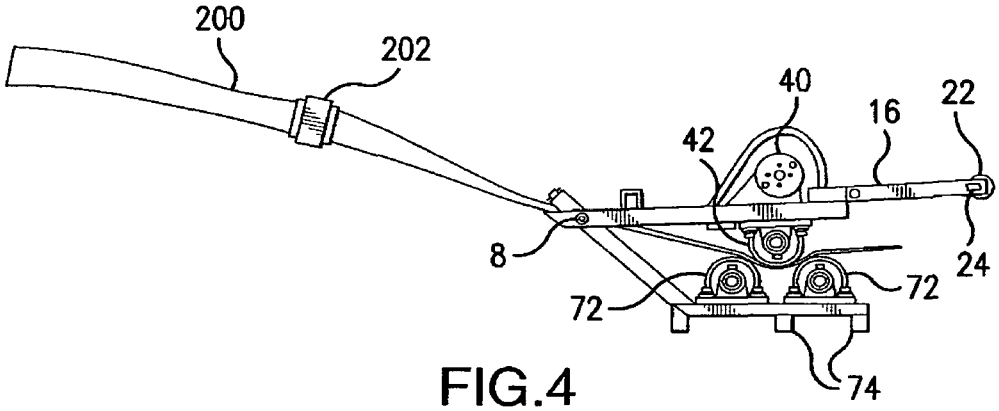
FIG. 4 is a side view of the present invention in action prior to encountering a hose coupling.
Figure 5:
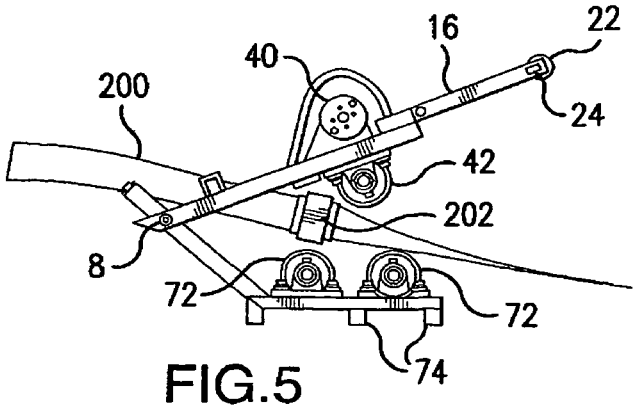
FIG. 5 is a side view of the present invention in action at the time a hose coupling is encountered.

Referring to FIGS. 4-5, where the principle of action of the transmission of this invention is shown, the apparatus for recovering hose as described in FIG. 1-3 receives the hose 200 for recovery in a direction from left to right and is adaptable to pass a hose coupling 202 therethrough without any difficulty. FIG. 4 shows the apparatus for recovering hose in a first position, wherein hose 200 has entered the apparatus for recovering hose by having been disposed through the plurality of guide rollers 12, which are preferably rotatable and which guide the hose 200 in a position to move through the apparatus for recovering hose. FIG. 4 further shows the hose 200 disposed between the rotational drive roller 42 and the plurality of lower rollers 72, preferably two lower rollers of substantially similar size to the rotational drive roller 42.

During the initiation of a hose recovery operation, the hose 200 should be positioned as shown in FIG. 4. An operator of the apparatus for recovering hose depresses the electric switch 24 to actuate the drive system as described above and shown in FIG. 2. Upon actuation of the drive system, in the first position, rotational drive roller 42 begins feeding the hose through the apparatus for hose recovery. The movement of the hose 200 caused by the initiation of rotational drive roller 42 additionally causes the plurality of lower rollers 72 which are also in contact with the hose 200 to rotate about their axes. Once the hose 200 passes through the apparatus for recovering hose, the hose 200 can be collected, and preferably flaked and stored in the fire truck. The operator of the apparatus for recovering hose manually applies downward pressure to the lifting arm 16 so that the rotational drive roller 42, the hose 200, and the plurality of lower rollers 72 remain in contact throughout the hose recovery operation.

FIG. 5 illustrates the time in a hose recovery operation when the apparatus for recovering hose encounters a hose coupling 202. During the hose recovery operation, when a hose coupling 202 is encountered, the operator while continuing to depress the electric switch 24, the operator will manually lift the lifting handle 22 to raise the lifting arm 16 vertically into a second position to provide space for the hose coupling 202 to dispose between the rotational drive roller 42 and the plurality of lower rollers 72. The rotational driver roller 42 continually contacts the hose coupling 202 until the hose coupling 202 passes through the apparatus for recovering hose. For purposes of illustration, FIG. 5 shows the hose coupling 202 as not contacting the rotational drive roller 42 or the plurality of lower rollers 72. It is preferable for the rotational drive roller 42, the hose coupling 202, and the plurality of lower rollers 72 to remain in contact as to continue feeding of the hose 200 through the apparatus for hose recovery. In addition, in FIGS. 4-5, for purposes of illustration, the detachable support assembly has been detached.

After the hose coupling 202 passes through the apparatus for recovering hose, the operator will apply manual downward pressure to the lifting handle 22 as to allow the lifting arm 16 to descend back into the first position as shown in FIG. 4.

At any time during the hose recovery operation, the operator may release the electric switch 24 to terminate the power supply to the motor 40. Said release deactivates the drive system to the apparatus for recovering hose and will terminate the hose recovery operation.

Thus the reader will see that this apparatus for recovering hose allows for the efficient recovery of infinite quantities of coupled hose. The support assembly supporting the apparatus provides for free adjustment of the apparatus. The apparatus for recovering hose comprises fairly simple mechanical parts that are easy to maintain and that can easily be operated by a single operator.

It will further be understood that various changes in the details, materials and arrangements of the parts and parameters which have been described and illustrated to explain the nature of the invention may be made by those skilled in the art without departing from the principle and scope of the invention. Therefore, the spirit and scope of the appended claims should not be limited to the description of the preferred versions contained herein.

What is claimed is:

1. An apparatus for recovering hose comprising:

(a) a pair of lifting frame arms wherein at least one of the lifting frame arms is operatively connected to a lifting arm that is used to manually operate the pair of lifting frame arms through user force applied to the lifting arm and wherein the lifting arm is oriented in the same direction as the pair of lifting frame arms;

(b) a pair of guide roller mounts rotatably affixed to the pair of lifting frame arms in a manner that allows the pair of lifting frame arms to pivot about the pair of guide roller mounts when user force is applied to the lifting arm to allow the pair of lifting frame arms to be lowered into a first position and raised to a second position;

(c) at least one support arm attached between and perpendicular to the pair of lifting frame arms;

(d) a rotational drive roller operatively connected to a motor and secured at each end to the pair of lifting frame arms;

(e) a pair of lower roller support arms connected to the pair of guide roller mounts wherein each of the pair of guide roller mounts is directly connected to and supports one of a pair of guide rollers;

(f) at least one lower roller secured at each end to the pair of lower roller support arms;

(g) a plurality of lower roller support arm support members attached perpendicular to the pair of lower roller support arms and beneath the at least one lower roller; (h) an electric switch located on the lifting arm and operatively connected to the motor; and (i) a lifting handle connected to the lifting arm.

2. The apparatus of claim 1 wherein the lifting arm is designed to be removably attached to one of the at least one support arms wherein the lifting arm is dimensioned to fit inside at least a portion of the one of the at least one support arms and the lifting arm is capable of being reattached to one of the at least one support arms after removal by inserting the lifting arm inside at least the portion of the one of the at least one support arms and wherein the pair of guide rollers extend parallel to the pair of guide roller mounts.

3. The apparatus of claim 2 further comprising:

a pair of storage brackets affixed to the pair of lifting frame arms and sized to accommodate the lifting arm when it is removed and a safety plate covering the at least one support arm and at least one of the pair of lifting frame arms.

4. The apparatus of claim 1 further comprising:

a motor sprocket, a rotational drive roller sprocket and an idler sprocket connected via a drive chain wherein the motor engages the motor sprocket and wherein the rotational drive roller sprocket is operatively connected to the rotational drive roller.

5. The apparatus of claim 4 further comprising:

a motor cowling covering the motor and a drive cowling covering the motor sprocket wherein the motor cowling and the drive cowling are removably attached to the pair of lifting frame arms.

6. The apparatus of claim 1 further comprising:

a tray plate attached to at least one of the plurality of lower roller support arm support members wherein the tray plate is further connected to a tray plate hub and spindle.

7. The apparatus of claim 6 wherein the tray plate hub and spindle are detachably affixed together by a tray plate lock pin.

8. The apparatus of claim 7 further comprising:

a tray plate locking handle to control rotation of the tray plate about the tray plate hub and spindle.

9. The apparatus of claim 7 further comprising:

a swing arm attached on one end to the tray plate hub and spindle and on the other end to a swing arm hub and spindle.

10. The apparatus of claim 9 further comprising:

a swing arm locking handle that controls rotation of the swing arm about the swing arm hub and spindle and a spring loaded tray plate lock pin that permits the swing arm hub and spindle to be removed from a base plate.

11. A method of recovering hose, comprising the steps of:

(a) disposing a hose between a powered rotational drive roller secured at each end to a pair of lifting frame arms and a plurality of lower rollers;

(b) actuating a motor by depressing an electric switch which causes the powered rotational drive roller to rotate;

(c) raising a lifting arm oriented in the same direction as the pair of lifting frame arms by a lifting handle connected to the lifting arm wherein the lifting arm is directly connected to at least one of the pair of lifting frame arms which are rotatably affixed to a pair of guide roller mounts in a manner that allows the pair of lifting frame arms to pivot about the pair of guide roller mounts to provide an additional space between the powered rotational drive roller secured at each end to the pair of lifting frame arms and the plurality of lower rollers to allow passage of a hose coupling, wherein each of the pair of guide roller mounts is directly connected to and supports one of a pair of guide rollers, and wherein the electric switch is located on the lifting arm and operatively connected to the motor; and (d) lowering the lifting arm to remove the additional space between the powered rotational drive roller and the plurality of lower rollers.

* * * * *